US007841214B2

(12) United States Patent
Park

(10) Patent No.: US 7,841,214 B2
(45) Date of Patent: Nov. 30, 2010

(54) KNIT MATERIAL COLLAR FOR PREVENTING AN EXTENSION, PRODUCING METHOD THEREOF, AND UPPER GARMENT WITH THE COLLAR

(75) Inventor: Jung Nam Park, Hyundai l'Park Apt. #106-201, Sangdo 2-dong, Dongjak-gu, Seoul (KR) 156-834

(73) Assignee: Jung Nam Park, Seoul (KR)

( * ) Notice: Subject to any disclaimer, the term of this patent is extended or adjusted under 35 U.S.C. 154(b) by 382 days.

(21) Appl. No.: 11/920,496

(22) PCT Filed: Jun. 15, 2006

(86) PCT No.: PCT/KR2006/002288

§ 371 (c)(1),
(2), (4) Date: Nov. 16, 2007

(87) PCT Pub. No.: WO2006/137654

PCT Pub. Date: Dec. 28, 2006

(65) Prior Publication Data

US 2008/0190148 A1 Aug. 14, 2008

(30) Foreign Application Priority Data

Jun. 20, 2005 (KR) ..... 10-2005-0053069

(51) Int. Cl.
*D04B 1/22* (2006.01)

(52) U.S. Cl. ..... 66/172 E; 2/243.1

(58) Field of Classification Search ..... 66/172 E, 66/170, 169 R; 2/237, 236, 220, 221
See application file for complete search history.

(56) References Cited

U.S. PATENT DOCUMENTS

| | | | | | |
|---|---|---|---|---|---|
| 1,105,407 | A * | 7/1914 | Curtis | 66/172 R |
| 2,150,881 | A * | 3/1939 | King | 2/131 |
| 2,854,670 | A * | 10/1958 | Naccash | 2/237 |
| 2,928,098 | A * | 3/1960 | Bihaly | 2/131 |
| 4,038,840 | A * | 8/1977 | Castello | 66/170 |
| 5,040,244 | A * | 8/1991 | Tubbs | 2/237 |
| 5,168,581 | A * | 12/1992 | Garcia et al. | 2/237 |
| 5,758,519 | A * | 6/1998 | Joyce et al. | 66/83 |
| 5,963,988 | A * | 10/1999 | Jackson, Jr. | 2/243.1 |
| 6,286,341 | B2 * | 9/2001 | Jackson et al. | 66/83 |
| 7,607,323 | B1 * | 10/2009 | Hall | 66/173 |
| 7,654,116 | B1 * | 2/2010 | Trelease | 66/176 |
| 2007/0251636 | A1 * | 11/2007 | Herbert | 156/217 |

* cited by examiner

*Primary Examiner*—Danny Worrell
(74) *Attorney, Agent, or Firm*—LRK Patent Law Firm

(57) ABSTRACT

The present invention relates to a method for producing a knitted neck collar, and more particularly to a knitted neck collar prevented from drooping, wherein, when producing a neck collar using a knitted material, a narrow band having excellent elasticity and return force is inserted in the neck collar to prevent the neck collar from drooping, a method for producing the same, and a garment having the same. By the method for producing a knitted neck collar according to the present invention, it is possible to provide a knitted neck collar prevented from drooping even when a garment having the knitted neck collar is repeatedly put on and taken off and washed, thereby maintaining the original shape of the knitted neck collar, due to the fact that an elastic member having the same circumference as a distal end of the knitted neck collar is inserted in the neck collar and can be reliably positioned in the neck collar along the distal end of the neck collar.

6 Claims, 12 Drawing Sheets

[Fig. 1]
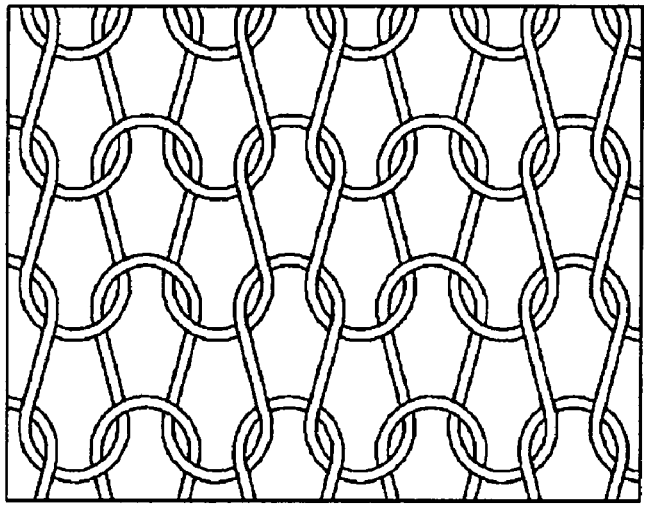
[Fig. 2]
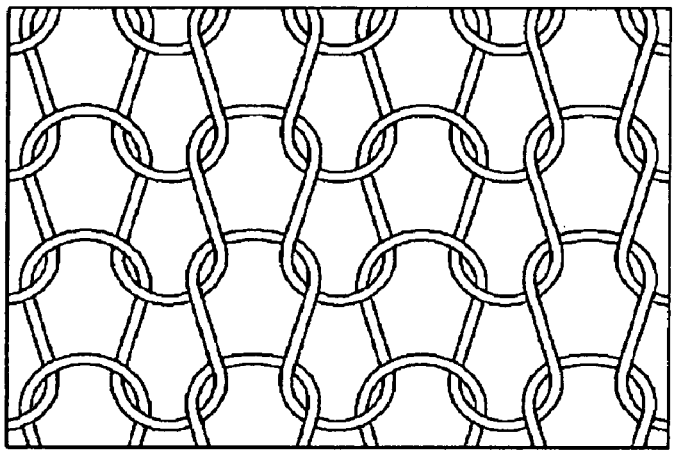
[Fig. 3]
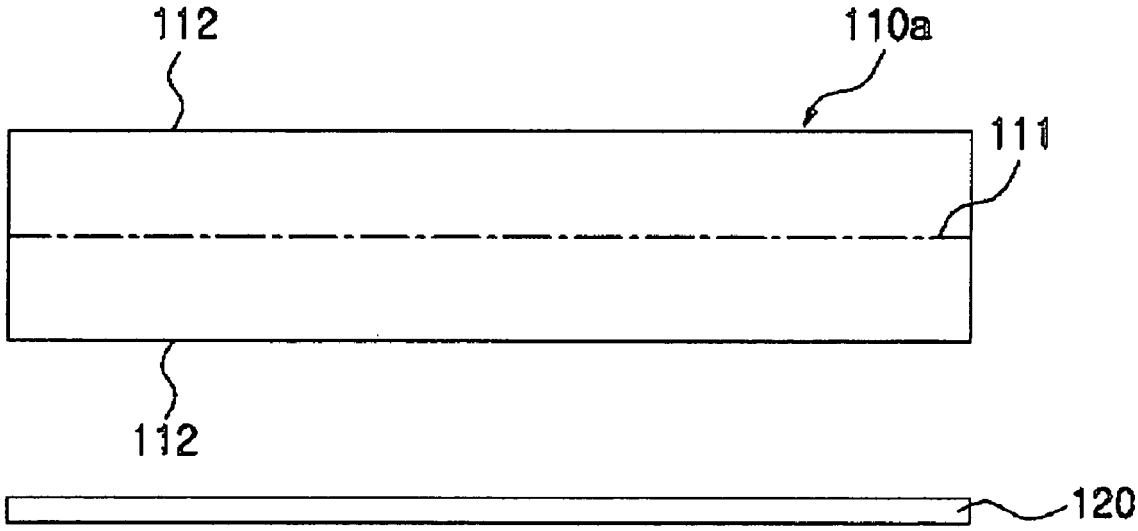

[Fig. 4]
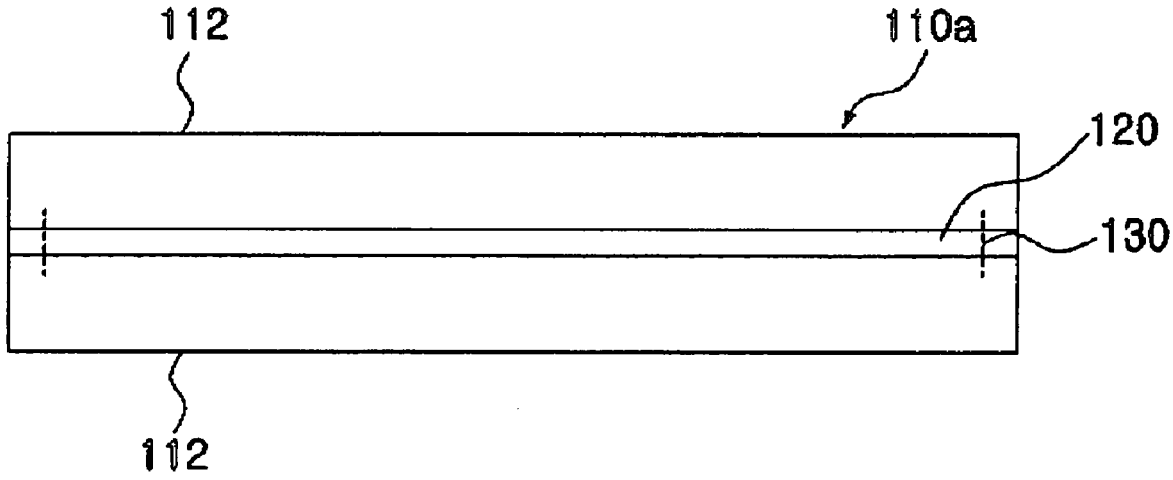
[Fig. 5]
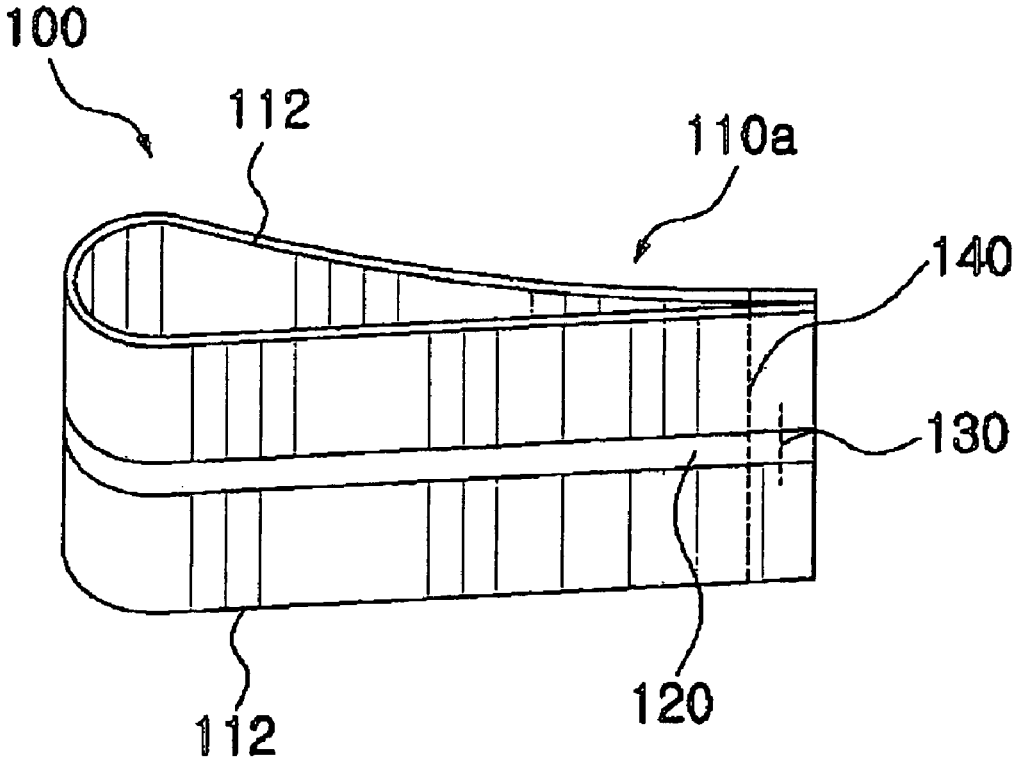

[Fig. 6]
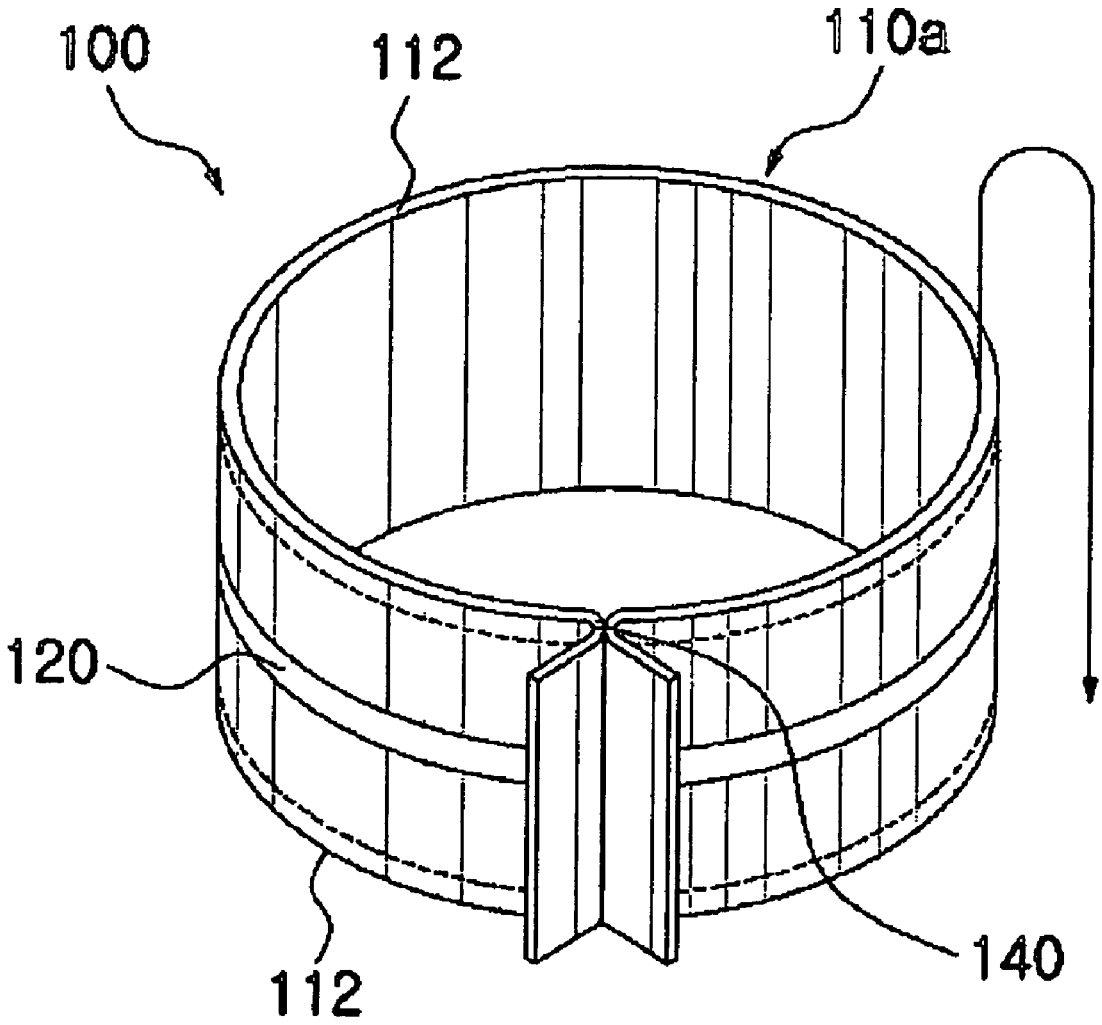

[Fig. 7]
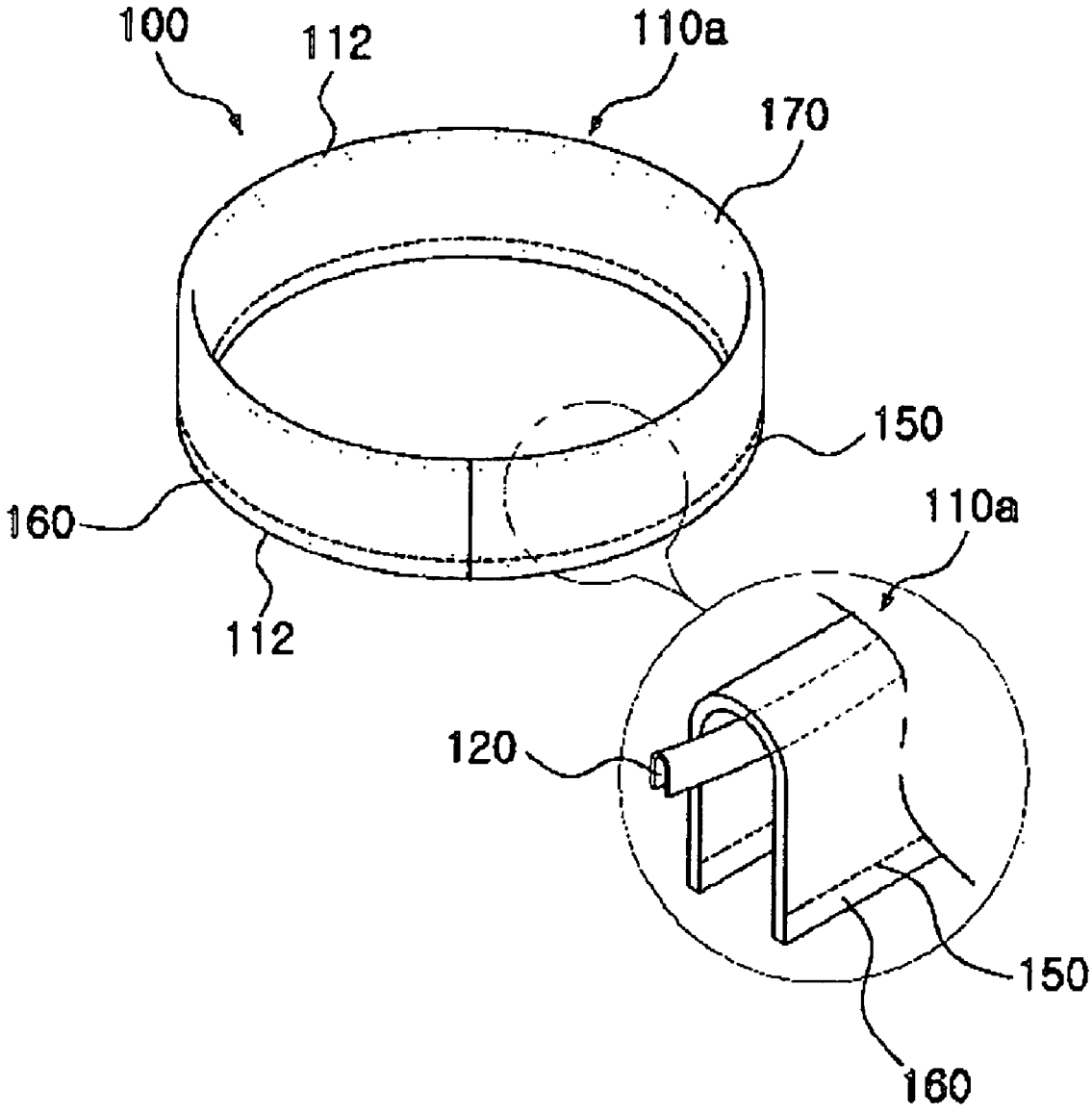

[Fig. 8]
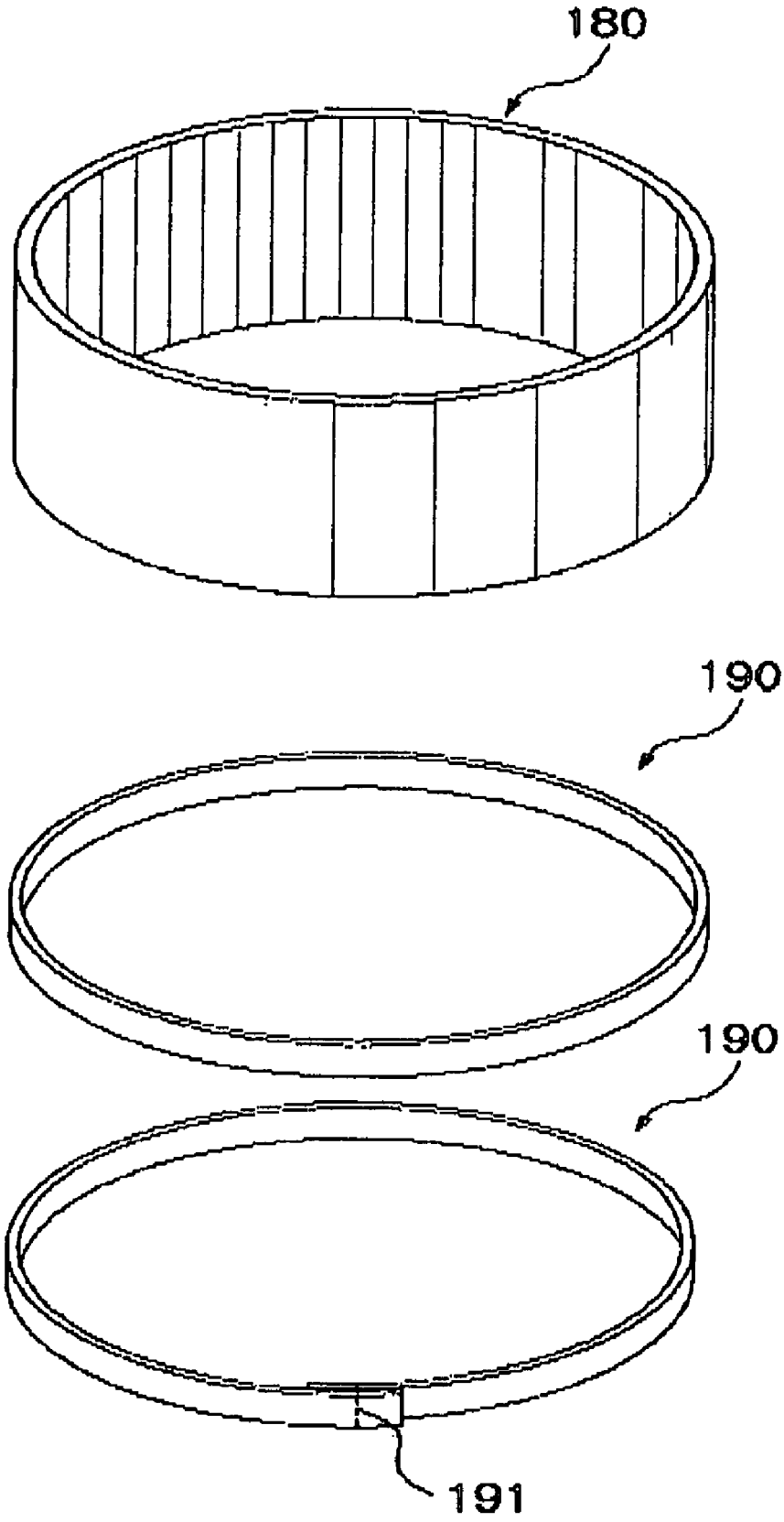

[Fig. 9]
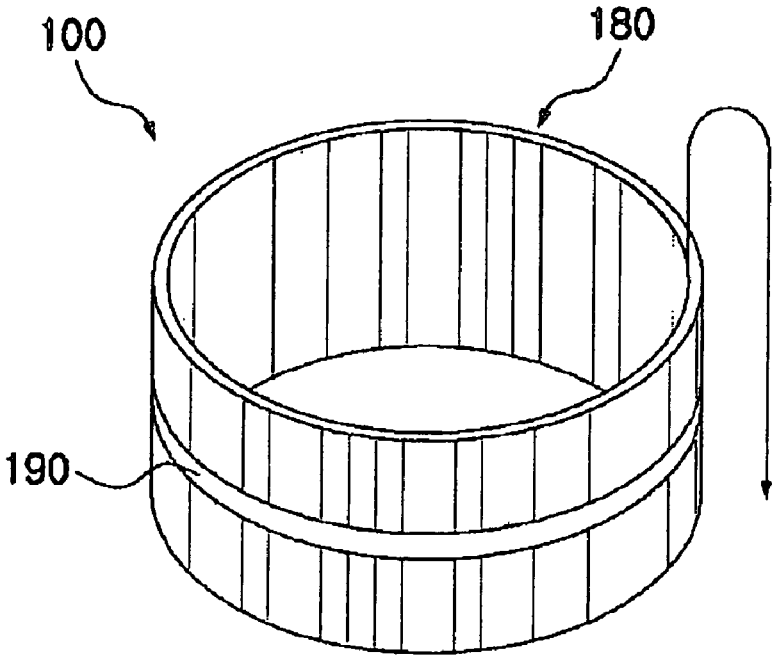
[Fig. 10]
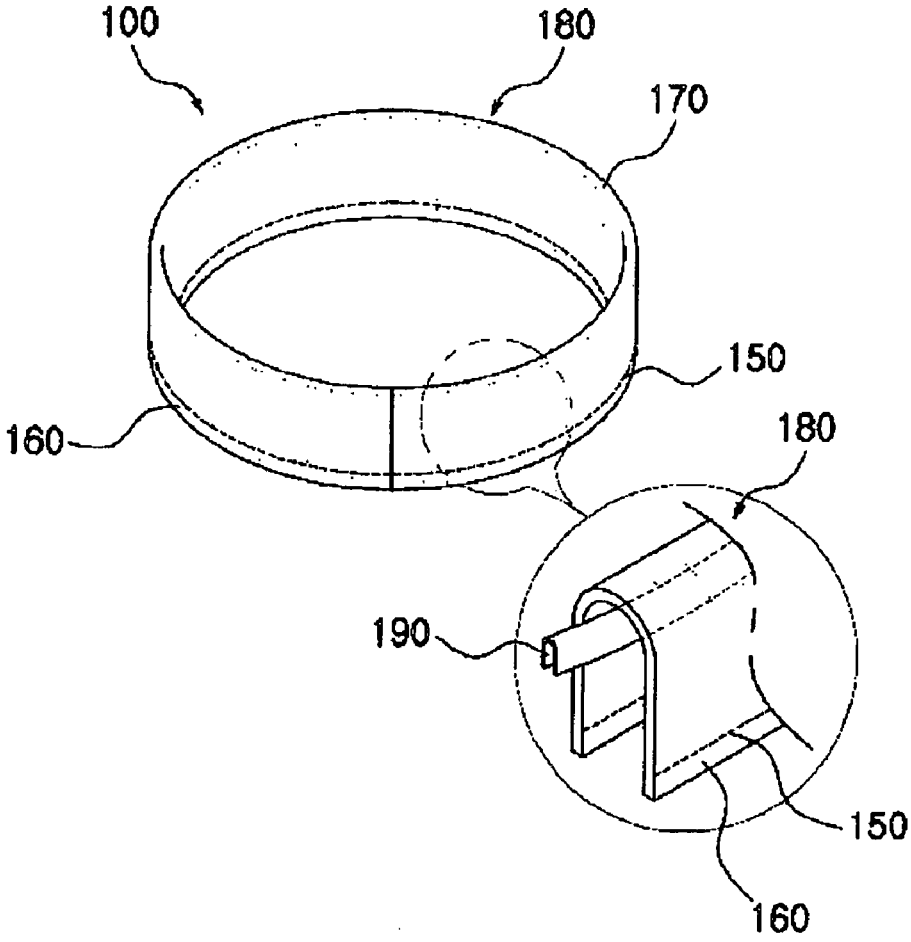

[Fig. 11]
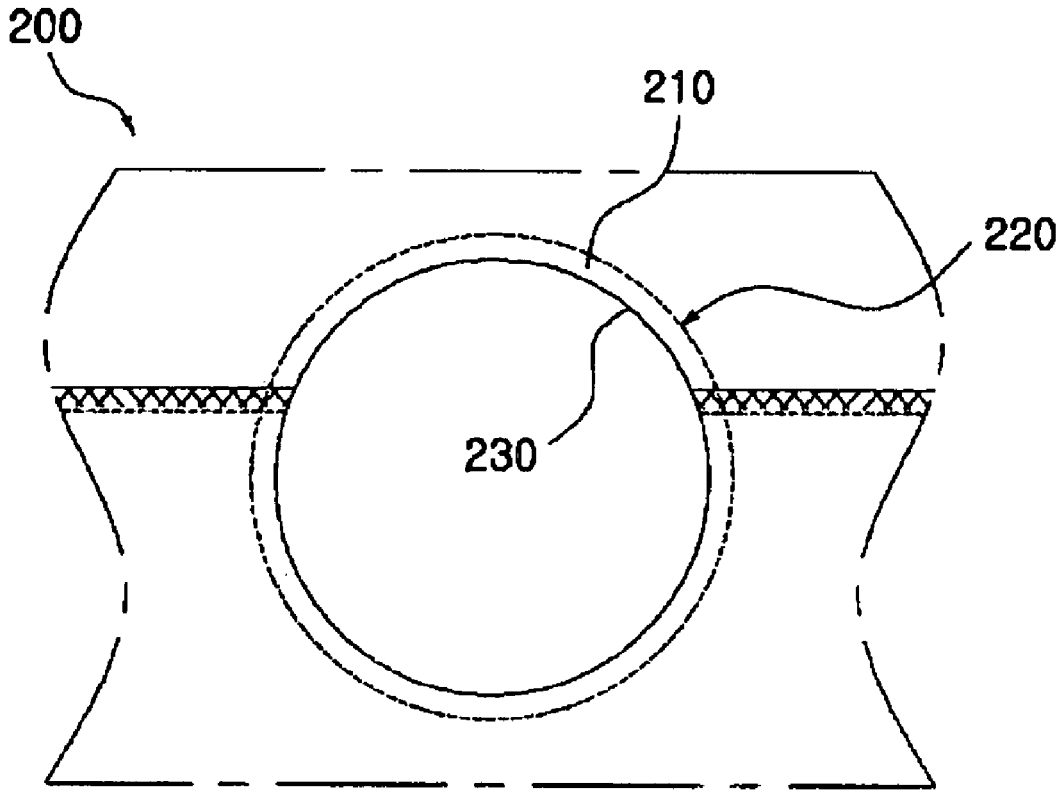
[Fig. 12]
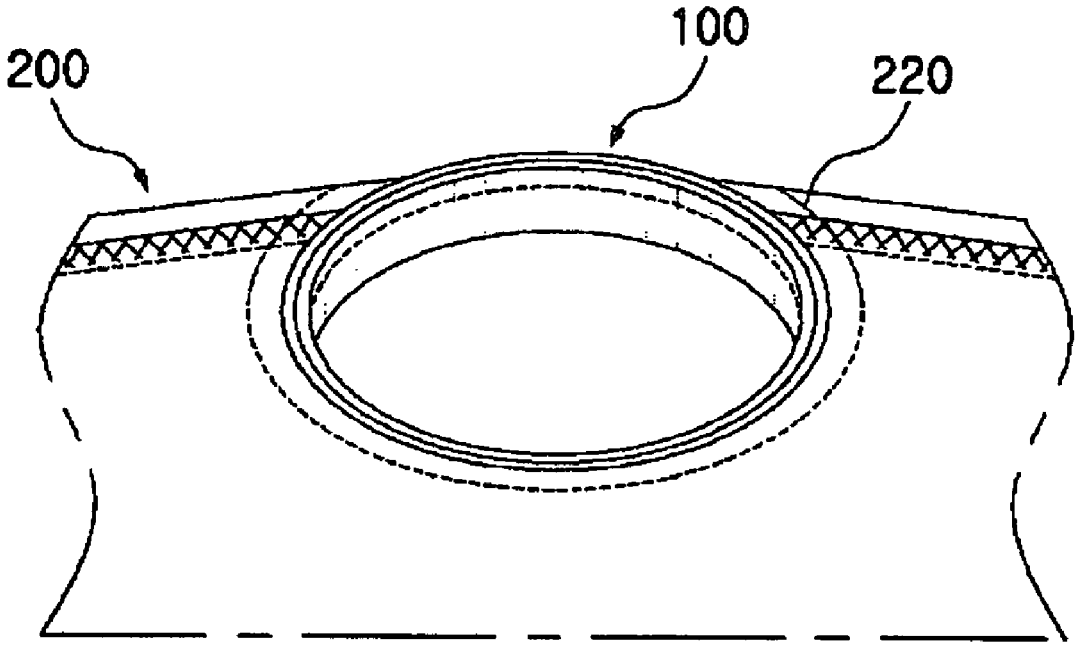

[Fig. 13]
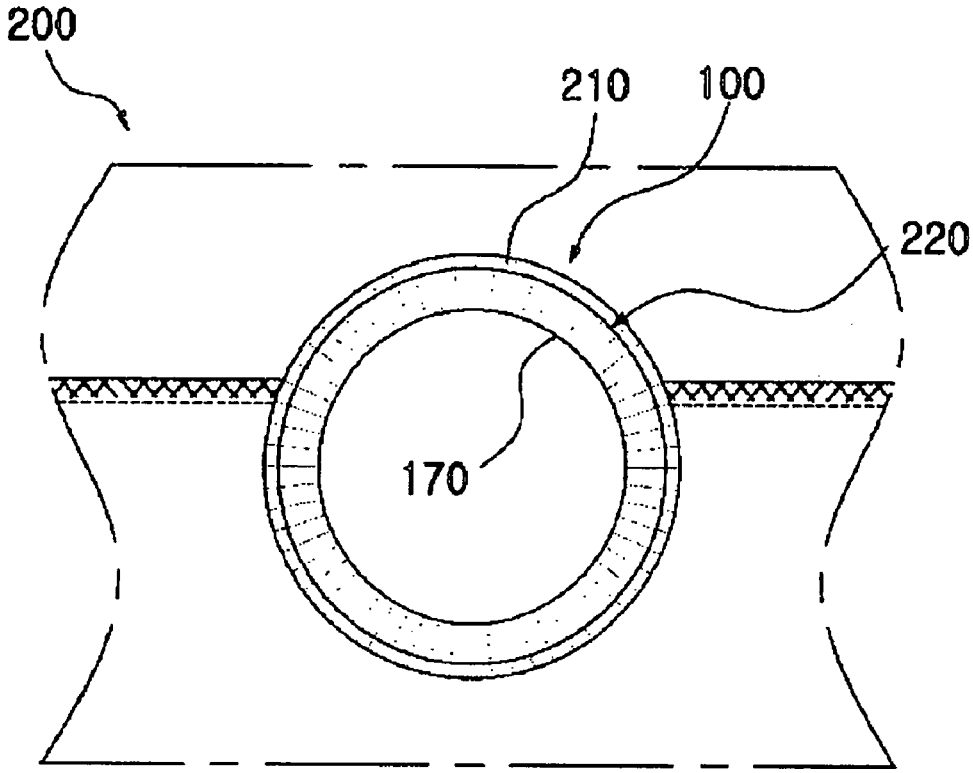
[Fig. 14]
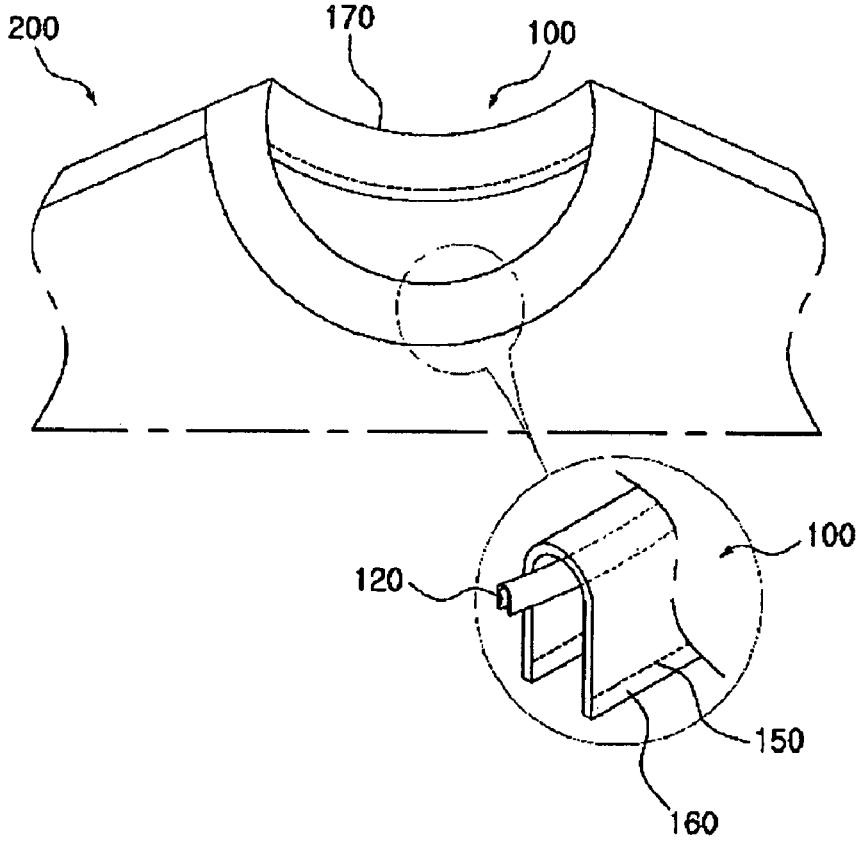

[Fig. 15]
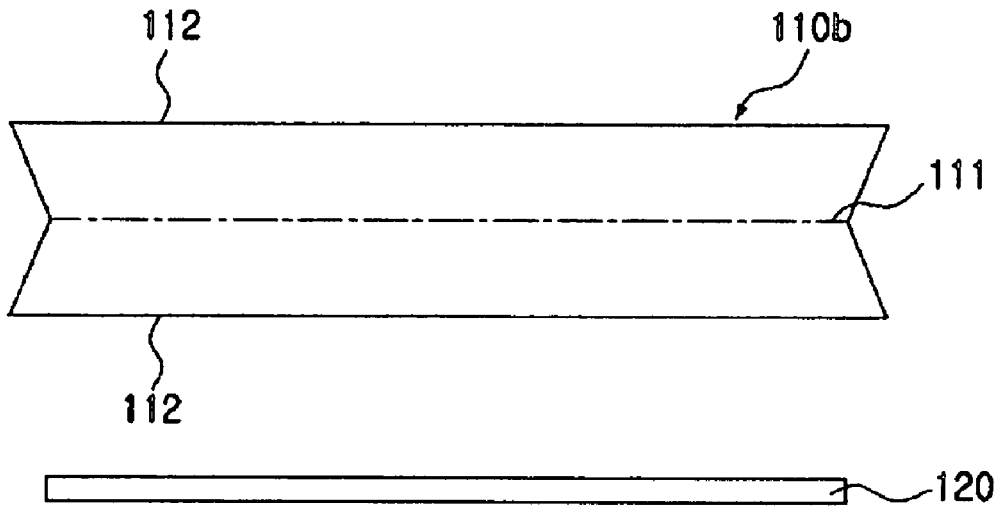
[Fig. 16]
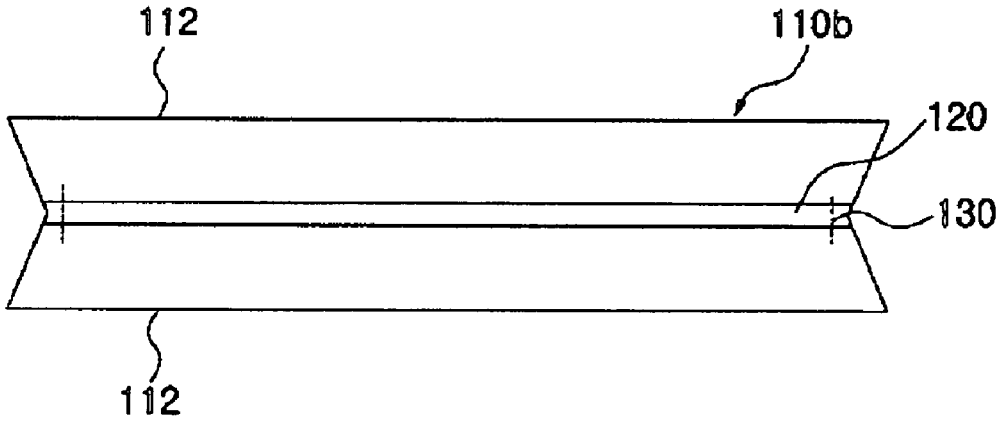
[Fig. 17]
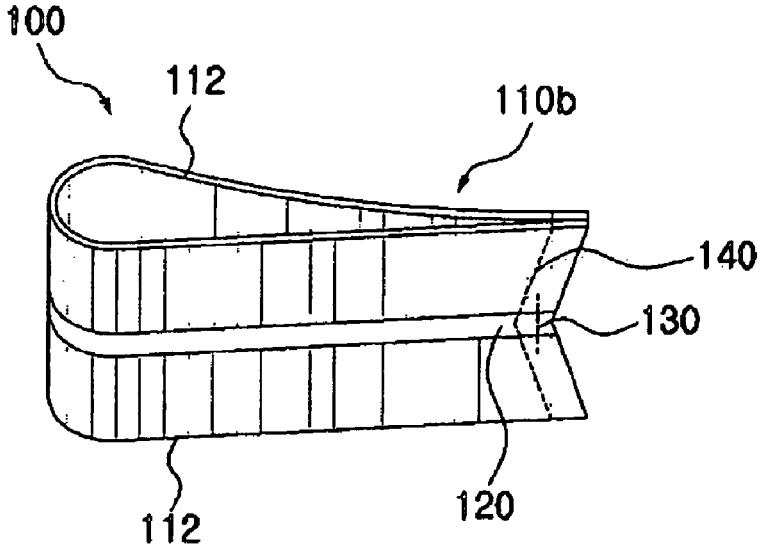

[Fig. 18]
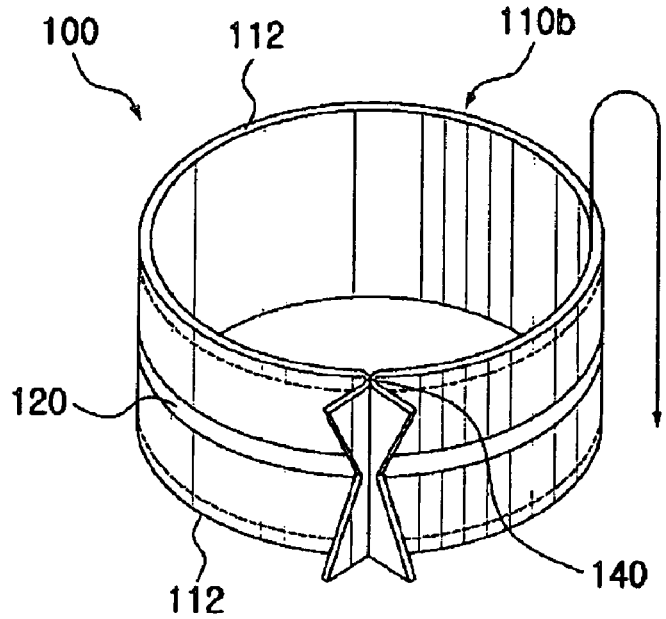
[Fig. 19]
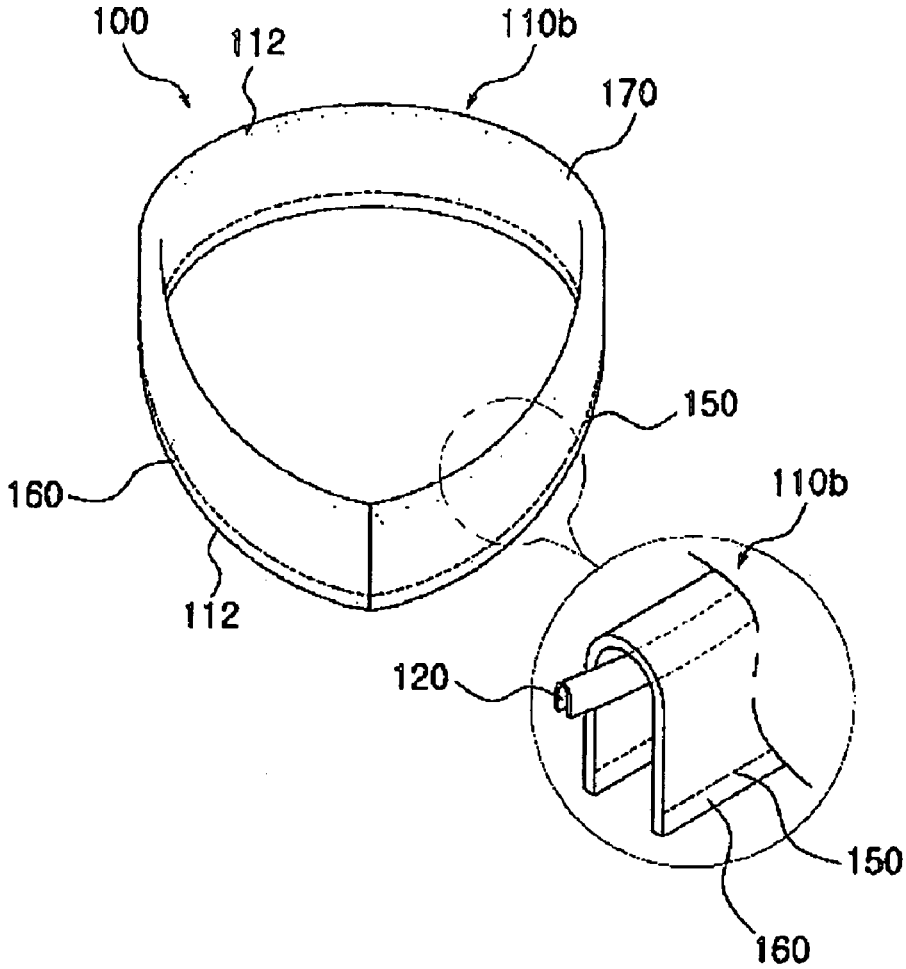

[Fig. 20]
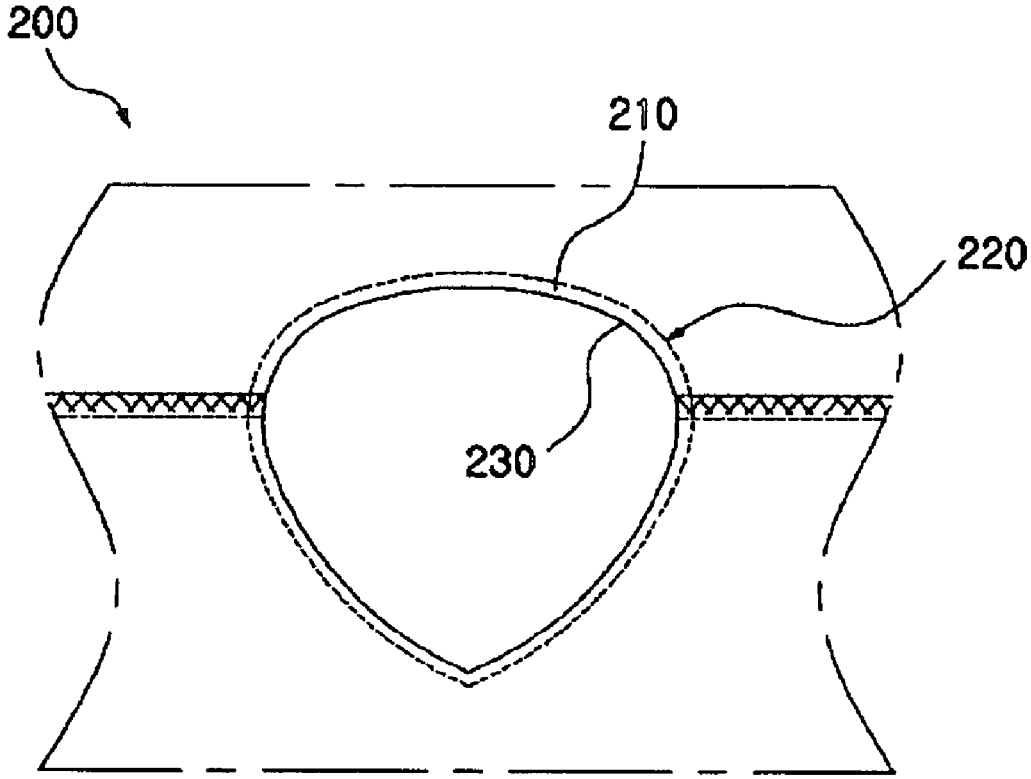
[Fig. 21]
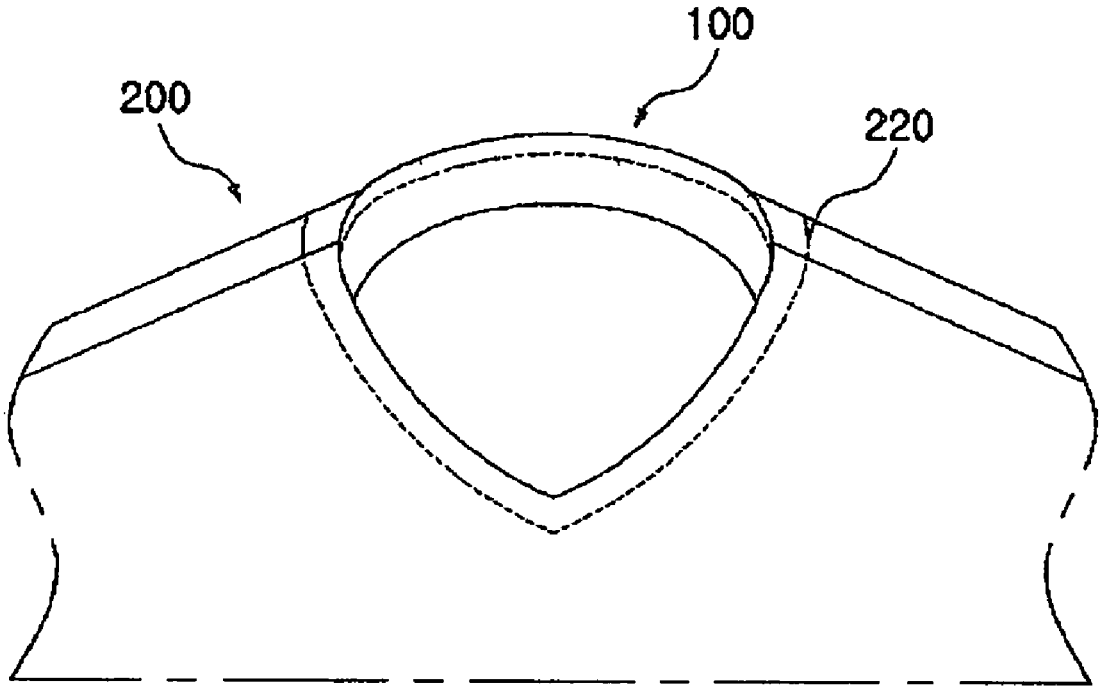

[Fig. 22]
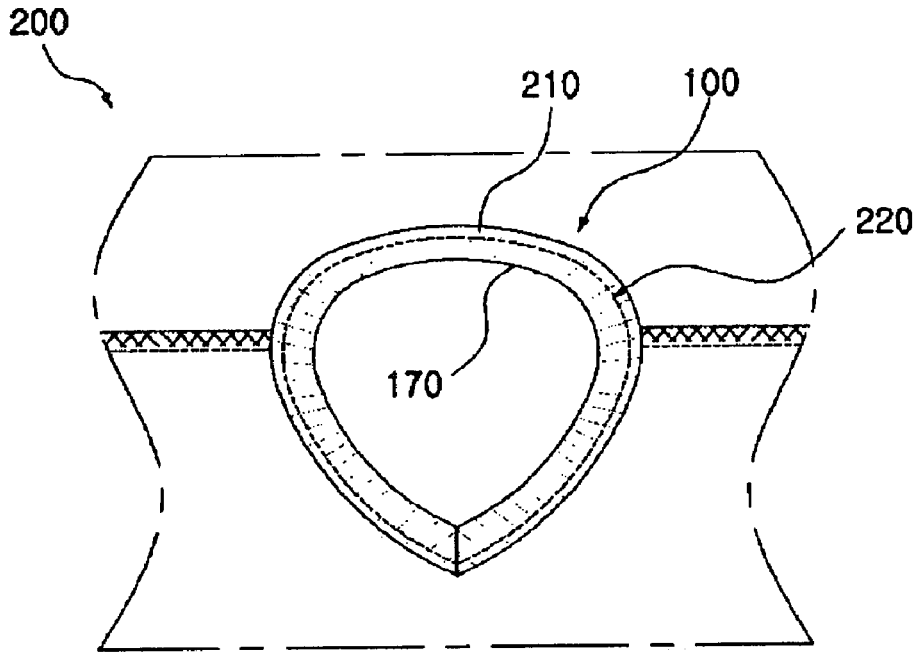
[Fig. 23]
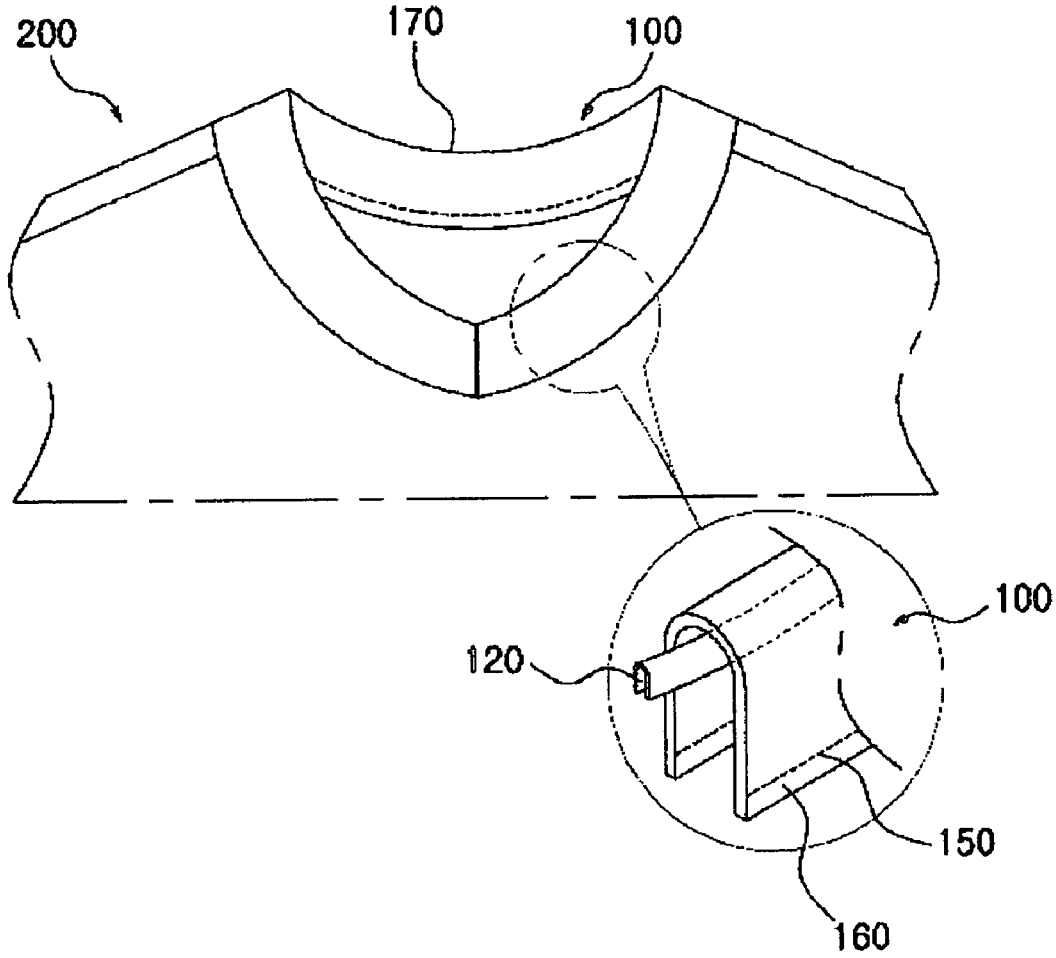

KNIT MATERIAL COLLAR FOR PREVENTING AN EXTENSION, PRODUCING METHOD THEREOF, AND UPPER GARMENT WITH THE COLLAR

TECHNICAL FIELD

The present invention relates to a method for producing a knitted neck collar, and more particularly to a knitted neck collar prevented from drooping, wherein, when producing a neck collar using a knitted material, a narrow band having excellent elasticity and return force is inserted in the neck collar to prevent the neck collar from drooping, a method for producing the same, and a garment having the same.

BACKGROUND ART

As is well known in the art, a method for manufacturing a garment, for example, a T-shirt, having a neck collar which is produced by folding a knitted material, is implemented as described below.

First, a T-shirt is designed. Then, a base pattern is made in conformity with the design, and a knitted material is cut in accordance with the base pattern. Then, a neck collar, a front bodice, a rear bodice, and sleeves are formed. Next, front and rear bodices are coupled with each other, and the sleeves are coupled to the resultant product to form a bodice. Thereafter, the neck collar is coupled to the bodice to complete the T-shirt.

There are two ways of forming a neck collar. In one way, a rectangular neck collar preform is cut from a flat knitted material to have a length which corresponds to the sum of two times the circumference of a finally produced neck collar and the lengths of inseams at both lengthwise ends of the finally produced neck collar, and to have a width which corresponds to the sum of two times the width of the finally produced neck collar and the widths of inseams at both widthwise ends of the finally produced neck collar. In the other way, a tubular knitted material having the same circumference as that of a finally produced neck collar is prepared and is then cut to have a width which corresponds to the sum of two times the width of the finally produced neck collar and the widths of inseams at both widthwise ends of the finally produced neck collar.

Meanwhile, in order to couple the neck collar to the bodice of a T-shirt, in the case where the knitted material is cut to have a rectangular shape, both end portions of the knitted material are sewn to form the shape of a round band which in turn is folded in the widthwise direction thereof to complete the neck collar, and then the completed neck collar is coupled to the bodice adjacent to the circular upper edge of the bodice that defines a neck opening. In the case where a tubular knitted material having the same circumference as that of a neck collar is cut, the tubular knitted material is simply folded in the widthwise direction thereof to complete the neck collar, and the completed neck collar is coupled to the bodice adjacent to the circular upper edge of the bodice that defines a neck opening.

At this time, since the circular upper edge of the bodice that defines a neck opening generally has a circumference which is greater than that of the neck collar, when attaching the neck collar to the bodice through sewing, the lower end portion of the neck collar which is attached to the bodice must be stretched so that it has the same circumference as the circular upper edge of the bodice. Then, the lower end portion of the neck collar is sewn to the bodice.

However, in the neck collar of the T-shirt produced as described above, due to the characteristic of the texture of the knitted material, as shown in FIG. 1*a*, loops of yarn are continuously interlocked with one another. Therefore, as the garment is repeatedly put on and taken off and washed, the yarn of the neck collar are gradually extended so that the loops are enlarged when compared to the original ones. Therefore, the neck collar loses its initial elastic return force and is stretched as shown in FIG. 1*b*. As a result, the neck collar being a part repeatedly expanded and contracted is likely to droop, whereby the aesthetic appearance of the garment is deteriorated, and the T-shirt may look worn-out.

In order to cope with this problem, as means for increasing the return force of the texture of the knitted material, a knitted fabric is made using yarn containing Spandex, which has a predetermined degree of elasticity. Nevertheless, while it is possible to retard the drooping of the neck collar because the texture of the knitted fabric made in this way still has loops interlocked with one another, as the garment having the knitted neck collar made in this way is repeatedly put on and taken off and washed, the neck collar is extended, whereby the aesthetic appearance of the garment is deteriorated and the T-shirt may look worn-out.

Therefore, demand necessarily exists in the art for a novel knitted neck collar which is capable of solving the above-described problem, and a method for producing the same.

DISCLOSURE OF INVENTION

Technical Problem

Accordingly, the present invention has been made to solve the above-mentioned problems occurring in the prior art, and an object of the present invention is to provide a method for producing a knitted neck collar prevented from drooping even when a garment having the knitted neck collar is repeatedly put on and taken off and washed, thereby maintaining the original shape thereof.

Another object of the present invention is to provide a knitted neck collar prevented from drooping even when a garment having the knitted neck collar is repeatedly put on and taken off and washed, thereby maintaining the original shape thereof.

Still another object of the present invention is to provide a garment having a knitted neck collar prevented from drooping even when a garment having the knitted neck collar is repeatedly put on and taken off and washed, thereby maintaining the original shape thereof.

Technical Solution

In order to achieve the first object, according to one aspect of the present invention, there is provided a method for producing a knitted neck collar having two folds, comprising the steps of preparing a flat cut segment from a piece of knitted material; placing an elastic member on the flat cut segment so that the elastic member extends from one end to the other end of the flat cut segment in a lengthwise direction of the flat cut segment; sewing one end and the other end of the flat cut segment together with the elastic member to form a cylindrical cut segment having attached thereto the elastic member; and folding into halves the cylindrical cut segment having attached thereto the elastic member such that the elastic member is inserted in the cylindrical cut segment and two folds of the cylindrical cut segment are flush with each other in a widthwise direction of the cylindrical cut segment.

According to another aspect of the present invention, in a state in which the cylindrical cut segment having attached thereto the elastic member is folded into halves, the elastic member is positioned adjacent to a folding line of the cylindrical cut segment.

According to another aspect of the present invention, the method further comprises the step of, after placing the elastic member on a center portion of the flat cut segment, tacking the elastic member to the flat cut segment.

According to another aspect of the present invention, the elastic member includes a linear band or strip.

In order to achieve the first object, according to another aspect of the present invention, there is provided a method for producing a knitted neck collar having two folds, comprising the steps of preparing a cylindrical cut segment from a piece of knitted material; placing an elastic member around the cylindrical cut segment; and folding the cylindrical cut segment into halves such that the elastic member is inserted in the cylindrical cut segment and two folds of the cylindrical cut segment are flush with each other in a widthwise direction of the cylindrical cut segment.

According to another aspect of the present invention, in the step of preparing a cylindrical cut segment from a piece of knitted material, a cylindrical knit is directly weaved to have a circumference corresponding to that of the neck collar, or both ends of a flat cut segment made of a knitted material are sewn together.

According to another aspect of the present invention, the elastic member includes a circular band or strip which has a circumference corresponding to that of the neck collar.

According to another aspect of the present invention, in a state in which the cylindrical cut segment is folded into halves, the elastic member is positioned adjacent to a folding line of the cylindrical cut segment.

In order to achieve the second object, according to another aspect of the present invention, there is provided a knitted neck collar formed to have two folds by folding a continuous piece of knitted material, wherein an elastic member is placed in the knitted neck collar such that the elastic member has the same circumference as a distal end of the knitted neck collar which is brought into contact with a person's neck.

According to still another aspect of the present invention, the elastic member is positioned adjacent to a folding line of the knitted neck collar.

In order to achieve the third object, according to yet still another aspect of the present invention, there is provided a garment having attached thereto the knitted neck collar produced by the method or the knitted neck collar as described above.

ADVANTAGEOUS EFFECTS

The present invention provides advantages as described below.

First, by the method for producing a knitted neck collar according to the present invention, it is possible to provide a knitted neck collar prevented from drooping even when a garment having the knitted neck collar is repeatedly put on and taken off and washed, thereby maintaining the original shape of the knitted neck collar.

Also, in the knitted neck collar according to the present invention, due to the fact that an elastic member inserted in the neck collar can be reliably positioned in the neck collar along the distal end of the neck collar, the neck collar is prevented from drooping and can maintain its original shape thereof even when a garment having the knitted neck collar is repeatedly put on and taken off and washed.

Further, in a garment having a knitted neck collar according to the present invention, due to the fact that a knitted texture is prevented from drooping even when the garment having a knitted neck collar is repeatedly put on and taken off and washed, the neck collar can maintain its original shape thereof. Therefore, since the garment can always give a feeling of a new garment to a user who puts on the garment, it is possible to improve the marketability of the garment and arouse a customer s interest.

BRIEF DESCRIPTION OF THE DRAWINGS

The above and other objects, features and advantages of the present invention will be more apparent from the following detailed description when taken in conjunction with the accompanying drawings, in which:

FIG. 1 is an enlarged front view illustrating a rib knitting which is mainly used as a knitted material for a neck collar, in a non-drooped state;

FIG. 2 is an enlarged front view illustrating the rib knitting of FIG. 1 in a drooped state;

FIGS. 3 through 7 are views illustrating the operational processes of a method for producing a knitted neck collar prevented from drooping in accordance with an embodiment of the present invention;

FIGS. 8 through 10 are views illustrating the operational processes of a method for producing a knitted neck collar prevented from drooping in accordance with another embodiment of the present invention;

FIGS. 11 through 14 are views illustrating the operational processes for attaching the knitted neck collar produced in FIGS. 3 through 7 and FIGS. 8 through 10 to a bodice; and FIGS. 15 through 23 are views illustrating the operational processes for producing a knitted neck collar in accordance with a variation of FIG. 7 and for attaching the knitted neck collar produced to a bodice.

DESCRIPTION OF THE MAIN MARKS IN THE DRAWINGS

100: a neck collar 110*a*, 110*b*: a flat cut segment
111: a center portion of the flat cut segment
112: an upper and lower lines in the lengthwise direction of the flat cut segment
120: a linear elastic member
130: a linear elastic member tacking lines
140: a sewing line which connects both ends of the flat cut segment
150: a neck collar sewing line 160: neck collar inseams
170: a neck collar end 180: a cylindrical cut segment
190: an elastic member having a circular shape
200: a bodice 210: a bodice inseam
220: a bodice sewing line 230: a neck line of the bodice

MODE FOR THE INVENTION

Before concretely explaining the present invention, the meanings of the terms used in the present specification will be defined as described below.

A neck collar used in the present specification indicates a component part of an upper garment which is brought into direct contact with the neck of a person wearing the upper garment. Here, in a state in which a completely formed neck collar is not attached to a bodice, the neck collar has a cylindrical configuration which is folded into two folds. One end of the cylindrical configuration at which the two folds are joined with each other serves as a neck collar end, and the other end of the cylindrical configuration at which the two folds are separated from each other serves as a bodice end to be coupled to the bodice of the garment. In the state in which the neck collar is not attached to the bodice, the neck collar which has the cylindrical configuration possesses the same circumference at the neck collar end and at the bodice end.

An elastic member designates a well-known elastic element which is thin and narrow and has predetermined elasticity, that is, contractibility. Preferably, the elastic member has a thickness and a width which do not deteriorate the aesthetic appearance of the garment when the elastic member is inserted in the garment.

A cut segment means a knitted material which is cut as designed to produce a desired neck collar.

The bodice indicates a state in which all remaining component parts excluding the neck collar are coupled with one another.

A sewing line means a line to be sewn or an already sewn line.

Hereinafter, preferred embodiments of the present invention will be described with reference to the accompanying drawings. In the following description and drawings, the same reference numerals are used to designate the same or similar components, and so repetition of the description on the same or similar components will be omitted. The attached drawings are used not to limit the scope of the present invention, but to help the understanding of the present invention.

FIGS. 3 through 7 are views illustrating the operational processes of a method for producing a knitted neck collar prevented from drooping in accordance with an embodiment of the present invention.

Referring to FIG. 3, in order to produce a neck collar 100 having a desired design, a flat cut segment 110*a* is prepared by cutting a piece of knitted material into a desired shape. The flat cut segment 110*a* possesses a rectangular shape and has cut lines 112 on upper and lower ends thereof, which extend in the lengthwise direction of the flat cut segment 110*a*. The flat cut segment 110*a* further has a center portion 111 between the upper and lower cut lines 112.

A linear elastic member 120 which has the same length as the length of the flat cut segment 110*a* is prepared. Here, the elastic member 120 indicates a well-known elastic element having predetermined elasticity, that is, contractibility, which can be extended by application of force and can be returned to its original shape by removal of the applied force. Preferably, the elastic member 120 includes a band or strip which is narrow and elongate so that the shape of a garment having attached thereto the neck collar 100 is not changed when the elastic member 120 is inserted in the neck collar 100.

Referring to FIG. 4, the linear elastic member 120 is placed on the center portion 111 of the flat cut segment 110*a*. Then, the linear elastic member 120 and the flat cut segment 110*a* are tacked with each other so that the elastic member 120 is fastened to the center portion 111 of the flat cut segment 110*a*, by which linear elastic member tacking lines 130 are formed. It is preferred that the tacking operation is performed at both ends of the linear elastic member 120. As the case may be, the tacking operation may be omitted.

Referring to FIG. 5, one lengthwise end and the other lengthwise end of the flat cut segment 110*a* are sewn together with the elastic member 120 to form a sewing line 140 which connects both ends of the flat cut segment 110*a*, by which a cylindrical cut segment having attached thereto the elastic member 120 is prepared. That is to say, one lengthwise ends and the other lengthwise ends of the flat cut segment 110*a* and the elastic member 120 are appropriately superimposed and then sewn together to define a cylindrical configuration, whereby the sewing line 140 for connecting both ends of the flat cut segment 110*a* is formed. At this time, it is preferred that the inseams formed by sewing the flat cut segment 110*a* and the elastic member 120 be turned over in opposite directions so that the thickness of the neck collar 100 does not increase at the sewing region.

Referring to FIG. 6, the cylindrical cut segment having attached thereto the elastic member 120 is folded into halves in a direction indicated by the arrow such that the attached elastic member 120 is in the folded cylindrical cut segment and the two folds of the cylindrical cut segment are flush with each other, by which the neck collar 100 is completed. With the neck collar 100 completed in this way, the elastic member 120 is positioned in the neck collar 100 along the distal end of the folded neck collar 100, that is, the neck collar end 170 of the neck collar 100 which is to be brought into contact with a person neck. Also, referring to FIG. 7, in the completed neck collar 100, a neck collar sewing line 150 and neck collar inseams 160 are formed on the proximal end of the completed neck collar 100 which is opposite the neck collar end 170.

FIGS. 8 through 10 are views illustrating the operational processes of a method for producing a knitted neck collar prevented from drooping in accordance with another embodiment of the present invention. This embodiment corresponds to the case of using a knitted material originally weaved into a cylindrical configuration to form a circular neck collar. Referring to FIG. 8, in order to produce a neck collar 100 having a desired design, a cylindrical cut segment 180 having a desired size is prepared from a piece of knitted material which is originally weaved into a cylindrical configuration.

Also, an elastic member 190 which is to be sewn into a circular shape so as to have the same circumference as the cylindrical cut segment 180 is prepared. Here, the elastic member 190 indicates a well-known elastic element having predetermined elasticity, that is, contractibility, which can be extended by application of force and can be returned to its original shape by removal of the applied force. The elastic member 190 includes a band or strip which is narrow and elongate so that the shape of a garment having attached thereto the neck collar 100 is not changed when the elastic member 190 is inserted in the neck collar 100, and both ends of which are connected with each other along a connection line 191. Alternatively, the elastic member 190 may also originally include a circular band-shaped element.

Referring to FIG. 9, the elastic member 190 having the circular shape is placed around the cylindrical cut segment 180. Then, the cylindrical cut segment 180 having attached therearound the elastic member 190 is folded into halves in a direction indicated by the arrow such that the attached elastic member 190 is positioned in the folded cylindrical cut segment 180 and the two folds of the cylindrical cut segment 180 are flush with each other, by which the neck collar 100 is completed. In the neck collar 100 completed in this way, the elastic member 190 is positioned in the neck collar 100 along the distal end of the folded neck collar 100, that is, the neck collar end 170 of the neck collar 100 which is to be brought into contact with a person's neck. Also, referring to FIG. 10, in the completed neck collar 100, a neck collar sewing line 150 and neck collar inseams 160 are formed on the proximal end of the completed neck collar 100.

FIGS. 11 through 14 are views illustrating the operational processes for attaching the knitted neck collar produced in FIGS. 3 through 7 and FIGS. 8 through 10 to a bodice. In other words, FIGS. 11 through 14 illustrates the operational processes for sewing along the neck collar sewing line 150 of the neck collar 100 in which the elastic member 190 is inserted and which is produced in accordance with the method shown in FIGS. 3 through 7 and FIGS. 8 through 10 and along the bodice sewing line 220 of a bodice 200 which is formed by coupling a front bodice and a rear bodice to each other.

FIG. 11 illustrates the neck part of the bodice 200 through which the neck collar 100 is inserted. The inside portions of the rear bodice and the inside portions of the front bodice are coupled with each other by shoulder inseams. The bodice 200 defines a neck opening through which the neck collar is coupled to the bodice 200. The neck part of the bodice 200 is composed of a neck line 230 which defines the neck opening, a bodice inseam 210, and a bodice sewing line 220.

FIG. 12 illustrates a process for coupling and sewing the completed neck collar 100 to the neck part of the bodice 200. The neck collar 100 produced in accordance with the method shown in FIGS. 3 through 7 or FIGS. 8 through 10 is inserted into the neck opening of the bodice 200 defined as shown in FIG. 11, and the proximal end of the neck collar 100 opposite the neck collar end 170 is superimposed over the neck line 230 of the bodice 200 so that the neck collar 100 can be sewn to the bodice 200. At this time, since the neck line 230 of the bodice 200 has a circumference greater than that of the proximal end of the neck collar 100, the proximal end of the neck collar 100 must be stretched so that it has the same circumference as the neck line 230 of the bodice 200. Then, the neck collar 100 is sewn to the bodice 200 along the neck collar sewing line 150 of the neck collar 100 and the bodice sewing line 220 of the bodice 200.

FIG. 13 illustrates a plan view of the bodice 200 to which the neck collar 100 is coupled. In FIG. 13, the neck collar end 170 of the neck collar 100 has the same circumference as when the neck collar 100 is completed. However, the circumference of the proximal end of the neck collar 100, which is opposite the neck collar end 170, is increased in comparison with the time the neck collar 100 is completed, so that, with the neck collar 100 completely coupled to the bodice 200, the neck collar 100 has a substantially frusto-conical configuration as shown in FIG. 13. At this time, since the circumference of the inserted elastic member 120 and 190 is the same as that of the neck collar end 170, the elastic member 120 can be reliably positioned in the neck collar 100 along the distal end, that is, the neck collar end 170 of the neck collar 100.

FIG. 14 is a front view illustrating the neck section of an upper garment which is reversed with the outer surface of the garment facing outward. The outside portion of the rear bodice, the outside portion of the front bodice and the neck collar 100 of the completed upper garment are illustrated.

FIGS. 15 through 23 are views illustrating the operational processes for producing a knitted neck collar in accordance with a variation of FIGS. 3 through 7 and for attaching the knitted neck collar produced to a bodice. In particular, FIGS. 15 through 23 illustrate the operational processes for producing an upper garment having a V-shaped neck collar using the method for producing a knitted neck collar according to the present invention.

In this embodiment shown in FIGS. 15 through 23 serving as a variation of the embodiment shown in FIGS. 3 through 7, a flat cut segment 110*b* is prepared by cutting a piece of knitted material into a desired shape. Except for the process for forming the flat cut segment 110*b*, the neck collar 100 is produced through the same operational procedure as shown in FIGS. 3 through 7 and the neck collar 100 and the bodice 200 are coupled to each other through the same operational procedure as shown in FIGS. 11 through 14, so detailed description thereof will be omitted herein.

The neck collar 100 produced in accordance with FIGS. 3 through 7, FIGS. 8 through 10 or FIGS. 15 through 19 is coupled to the bodice 200 as shown in FIGS. 11 through 14 or FIGS. 20 through 23, to complete an upper garment such as a T-shirt, having the neck collar 100 made of a knitted material and folded into two folds. At this time, the upper garment such as a T-shirt is completed by coupling the neck collar 100 which is produced by inserting the elastic member 120 and 190 having excellent elasticity and return force and including a band, a strip or a string to the bodice 200.

Referring to FIGS. 14 and 23, the elastic member 120 and 190 inserted into the neck collar 100 of the upper garment such as a T-shirt are reliably positioned along the neck collar end 170 of the neck collar 100 which has the smallest circumference of the neck collar 100. Namely, in consideration of the characteristics of the knitted texture constituting the knitted material, in order to prevent the neck collar 100 made of the knitted material and folded into two folds from drooping when the garment is repeatedly put on and taken off and washed, the neck collar 100 is produced in a state that the elastic member 120 and 190, which has excellent elasticity and return force and possesses the same circumference as the neck collar end 170, is inserted in the neck collar end 170. Then, by coupling the neck collar 100 to the bodice 200, as the circumference of the proximal end of the neck collar 100 increases, the neck collar end 170 of the neck collar 100 has the smallest circumference. By this fact, the elastic member 120 and 190 inserted in the neck collar end 170 can be reliably maintained in place.

Accordingly, when wearing the upper garment having the neck collar 100, since the elastic members 120 and 190 have predetermined contractibility, the elastic member 120 and 190 can be stretched along with the neck collar 100 made of the knitted material. After the upper garment is worn, the elastic members 120 and 190 return to its original position around a person's neck. Therefore, while the upper garment having the knitted neck collar 100 is repeatedly put on and taken off and washed, the elastic member 120 and 190 which has predetermined contractibility and reliably maintained in the neck collar end 170 prevents the knitted texture of the neck collar end 170 from being gradually extended as shown in FIG. 2 and rather allows the knitted texture of the neck collar end 170 to be held in the state shown in FIG. 1. That is to say, even when the upper garment is washed, due to the presence of the elastic member 120 and 190, the neck collar 100 is prevented from drooping. Also, even when the knitted texture of the neck collar 100 is extended to some extent, the elastic members 120 and 190 are willing to return to its original position around the wearer s neck helps the knitted texture return, whereby the neck collar 100 can be returned to its original position.

INDUSTRIAL APPLICABILITY

Although preferred embodiments of the present invention have been described for illustrative purposes, those skilled in the art will appreciate that various modifications, additions and substitutions are possible, without departing from the scope and spirit of the present invention as disclosed in the accompanying claims. For example, if a knitted neck collar is formed by folding a continuous piece such that an elastic member having the same circumference as the distal end of the neck collar which is brought into contact with the neck of a wearer is placed in the neck collar, it is to be understood that the knitted neck collar falls under the scope of the present invention even though it is produced by a method which is different from those as described in the embodiments of the present invention.

What is claimed is:

1. A method for producing a knitted neck collar having two folds, comprising the steps of:

preparing a flat cut segment from a piece of knitted material;

placing an elastic member on the flat cut segment so that the elastic member extends from one end to the other end of the flat cut segment in a lengthwise direction of the flat cut segment;

sewing one end and the other end of the flat cut segment together with the elastic member to form a cylindrical cut segment having attached thereto the elastic member; and folding into halves the cylindrical cut segment having attached thereto the elastic member such that the elastic member is inserted in the cylindrical cut segment and two folds of the cylindrical cut segment are flush with each other in a widthwise direction of the cylindrical cut segment, wherein, in a state in which the cylindrical cut segment having attached thereto the elastic member is folded into halves, the elastic member is positioned contiguous to a folding line of the cylindrical cut segment.

2. The method as claimed in claim 1, further comprising the step of:

after placing the elastic member on a center portion of the flat cut segment, tacking the elastic member to the flat cut segment.

3. The method as claimed claim 1, wherein the elastic member comprises a linear hand or strip.

4. A method for producing a knitted neck collar having two folds, comprising the steps of:

preparing a cylindrical cut segment from a piece of knitted material;

placing an elastic member around the cylindrical cut segment; and folding the cylindrical cut segment into halves such that the elastic member is inserted in the cylindrical cut segment and two folds of the cylindrical cut segment are flush with each other in a widthwise direction of the cylindrical cut segment, wherein, in a state in which the cylindrical cut segment is folded into halves, the elastic member is positioned contiguous to a folding line of the cylindrical cut segment.

5. The method as claimed in claim 4, wherein, in the step of preparing a cylindrical cut segment from a piece of knitted material, a cylindrical knit is directly weaved to have a circumference corresponding to that of the neck collar, or both ends of a flat cut segment made of a knitted material are sewn together.

6. The method as claimed in claim 4, wherein the elastic member comprises a circular band or strip which has a circumference corresponding to that of the neck collar.

* * * * *